US005299884A

United States Patent [19]

Westhoff et al.

[11] Patent Number: 5,299,884

[45] Date of Patent: Apr. 5, 1994

[54] WATER LOCK METHOD AND APPARATUS

[75] Inventors: James A. Westhoff, Langhorne; James A. Kelly, Warrington, both of Pa.

[73] Assignee: Poly-Tec Products, Inc., Tullytown, Pa.

[21] Appl. No.: 757,665

[22] Filed: Sep. 10, 1991

[51] Int. Cl.[5] ..... E02D 29/14

[52] U.S. Cl. ..... 404/25; 52/20

[58] Field of Search ..... 404/25, 26, 5; 52/19, 52/20; 277/207, 207 A, 237; 49/466; 210/163-166; 285/27, 175, 24, 32

[56] References Cited

U.S. PATENT DOCUMENTS

| | | | |
|---|---|---|---|
| 1,639,495 | 8/1927 | Frame . | |
| 1,710,571 | 4/1929 | Forni | 404/26 |
| 2,254,668 | 9/1941 | Tomek | 94/34 |
| 3,215,052 | 11/1965 | Lindstad et al. | 94/34 |
| 3,331,295 | 7/1967 | Sorrell | 94/34 |
| 3,362,425 | 1/1968 | Morris et al. | 404/26 X |
| 3,831,954 | 8/1974 | Longfellow | 277/207 |
| 4,236,358 | 12/1980 | Bowman | 404/26 X |
| 4,255,909 | 3/1981 | Soderstrom | 404/26 X |
| 4,305,679 | 12/1981 | Modi | 404/25 |
| 4,360,041 | 11/1982 | Hagan et al. | 138/89 |
| 4,368,893 | 1/1983 | Gagas | 404/25 X |
| 4,469,467 | 9/1984 | Odill et al. | 404/25 |
| 4,475,845 | 10/1984 | Odill et al. | 404/25 |
| 4,499,695 | 2/1985 | Oger et al. | 52/19 |
| 4,536,103 | 8/1985 | Prescott | 404/26 |
| 4,593,714 | 6/1986 | Madden | 404/26 X |
| 4,706,718 | 11/1987 | Milo | 404/26 X |
| 4,737,220 | 4/1988 | Ditcher et al. | 404/26 X |
| 4,759,656 | 7/1988 | Wilson | 404/26 |
| 4,932,686 | 6/1990 | Anderson, Jr. | 285/24 |
| 5,054,956 | 10/1991 | Huang | 404/26 |
| 5,095,667 | 3/1992 | Ryan et al. | 404/26 X |

OTHER PUBLICATIONS

Neenah Foundry Company, 1992 Catalog, p. 70.

*Primary Examiner*—Kenneth J. Dorner
*Assistant Examiner*—Nancy P. Connolly
*Attorney, Agent, or Firm*—Louis Weinstein

[57] ABSTRACT

A watertight chimney assembly prevents infiltration of water in the region between a manhole cover support frame and a concrete manhole assembly. The watertight chimney, in one embodiment, is comprised of a pair of tubular telescoping sleeves each provided with a flange for mounting respectively to and between the top lip of a manhole assembly and the bottom surface of a flange on the cover support frame supported a desired distance above the top of the manhole assembly to maintain the cover frame at proper grade. An O-ring seated within an annular groove provided in one of the tubular sleeves provides a sliding watertight seal therebetween. The sleeve flanges are arranged and compressed between the cover support frame and manhole assembly and contribute to the watertight seal. One of the sleeves is reversible to increase the telescoping range between a minimum and a maximum extension. In an alternative embodiment, the internal surface of the manhole opening constitutes one of the telescoping members. A sealing gasket may be arranged on either of the two telescoping members and may be seated within a groove or clamped against the manhole opening. The sealing gasket may be any one of a variety of cross-sectional configurations and can be inflatable, if desired. As another alternative embodiment, an anchoring flange of one of the telescoping sleeves may be embedded into the manhole opening. The cast-in sleeve may be formed of a resilient material and is clamped to the cooperating telescoping member.

45 Claims, 7 Drawing Sheets

WATER LOCK METHOD AND APPARATUS

FIELD OF THE INVENTION

The present invention relates to a method and apparatus for providing a watertight seal in the adjustment area between a manhole cover support frame and a manhole assembly, and more particularly, to a novel adjustable watertight assembly which provides a watertight seal which is superior to conventional method and apparatus employed for this purpose.

BACKGROUND OF THE INVENTION

Access to a manhole assembly is typically by means of a manhole cover which is supported within a cover frame positioned a spaced distance above the top opening in the manhole assembly and maintained at grade. One or more adjustment rings, typically referred to as grade rings, are arranged upon the top of the manhole assembly to provide support for the cover frame and to maintain the cover frame at grade level. The region occupied by the grade rings is highly susceptible to water infiltration and it is important to provide means and apparatus to prevent water from infiltrating into the adjustment region between the cover frame and the top of the manhole assembly to thereby prevent water from infiltrating into the interior of the manhole assembly.

Techniques for preventing water from infiltrating into the adjustment region are described in U.S. Pat. No. 4,737,220, issued Apr. 12, 1988 and U.S. Pat. No. 4,621,941 issued Nov. 1, 1986 and assigned to the assignee of the present invention. The aforementioned patents disclose a water lock chimney-type structure which, in addition to preventing water from infiltrating into the adjustment region, protects the interior adjustment region from corrosion within the system when sealed against the cast iron support frame thereby preventing hydrogen sulfide gas from contacting the concrete adjustment area.

Although the water lock arrangement disclosed in U.S. Pat. No. 4,737,220 has been very successful when all installation conditions are followed and met, the water lock structure has the disadvantage of wrinkling when the masonry work surrounding the rubber sleeve has a smaller inner diameter than the outer diameter of the sleeve, said wrinkling significantly reducing the access clearance for the manhole.

The above problem has been alleviated by placing an expandable stainless steel clamping band or ring at the top of the sleeve to prevent the rubber sleeve from protruding away from the masonry wall by urging the sleeve outwardly and clamping the sleeve against the masonry wall. The retention ring thus locks the sleeve to the surface directly behind the ring whereby the ring may be dislodged if any movement occurs to the surface behind the ring due to thermal expansion or contraction created by extreme temperature changes of the soil surface such as freeze or thaw cycles and further due to any vibration originating either upon or below the surface. The movement of the clamp may cause the clamp to dislodge and fall into the channel area of the manhole base which could result in a blockage of the flow of waste material in the system sewage, causing a back flow within the collector system. The clamping band may also contribute to a reduction in the access clearance opening.

The chimney lock assembly of U.S. Pat. No. 4,737,220 also necessitates being cast into the manhole assembly and may not be conveniently employed for installation in situ and has a limited expansion range.

BRIEF DESCRIPTION OF THE INVENTION

The present invention overcomes the limitations and disadvantages of the conventional water lock method and apparatus and is characterized by comprising, in one preferred embodiment thereof, a pair of telescoping sleeves each having a mounting flange arranged to be compressed between the top of the manhole assembly and the cover frame to provide a telescoping assembly which is adjustable to accommodate a greater or lesser number of grade rings and which incorporates a sealing gasket providing a watertight seal between the telescoping sleeves to prevent water from infiltrating into the adjustment region as well as protecting the concrete structure within the adjustment region from corrosion such as, for example, that due to hydrogen sulfide gas.

One of the water lock sleeves is provided with guiding tapers which facilitate insertion and positioning of the cooperating telescoping sleeve. The sleeve with the guide tapers is reversible, i.e. may be mounted with the cylindrical portion thereof extending either upwardly or downwardly from the mounting flange to provide for a maximum adjustment range to accommodate a larger number of grade rings as compared with conventional apparatus.

The inner sleeve is preferably provided with a corrugated section and a plurality of sealing gasket grooves for selective positioning of the sealing gasket along the surface thereof. The mounting flanges have a substantially rectangular periphery to significantly reduce precious storage space while providing a support flange of superior structural strength. The flanges are compressed between the frame and the top of the manhole assembly to further enhance the watertight seal. The flanges are preferably provided with elongated openings to compensate for fasteners which may be displaced from their desired positions.

The sealing gasket may be a conventional O-ring having a circular cross-section or may be provided with other cross-sections. The gasket may be inflatable.

In another preferred embodiment, the outer telescoping sleeve may be omitted and the manhole assembly opening fitted with a sealing gasket for telescopingly receiving the cooperating telescoping sleeve and providing a watertight seal therebetween. The gasket may be cast into the manhole assembly or clamped on to the gasket assembly, or alternatively, the opening may be machined to provide a right cylinder shape opening cooperating with the telescoping sleeve having sealing rings arranged about the outer periphery thereof.

The sealing ring, in addition to having a variety of different cross-sectional configurations may be inflatable to further enhance the watertight seal between the cooperating telescoping members.

As still another embodiment of the present invention, the lower sleeve may be formed of a resilient material having a flange which is cast into the manhole assembly. The upper sleeve is telescoping received within the resilient sleeve and an external clamp is utilized to provide a watertight seal when the upper sleeve is inserted within the resilient sleeve or, alternatively, an internal clamp is utilized when the resilient sleeve is inserted into the upper sleeve.

The design of the above embodiments greatly facilitates and simplifies installation while providing an excellent watertight seal and a shield to protect the concrete structure from corrosion.

OBJECTS OF THE INVENTION

It is, therefore, one object of the present invention to provide a novel telescoping assembly for sealing the adjustment region between a manhole assembly cover frame and the manhole assembly top opening against the infiltration of water.

Another object of the present invention to provide a novel telescoping assembly for sealing the adjustment region between a manhole assembly cover frame and the manhole assembly top opening against the infiltration of water and which is capable of axial expansion or contraction to accommodate changes in the spacing between the cover frame and manhole assembly.

Another object of the present invention is to provide a novel telescoping assembly which seals the adjustment region between a manhole cover frame and the top opening of a manhole assembly from infiltration of water, the telescoping assembly being non-load-bearing so as to greatly facilitate movement of the telescoping assembly to accommodate expansion and/or contraction of the manhole assembly in the adjustment region without affecting the load-bearing structure for the cover frame.

Still another object of the present invention is to provide a novel telescoping assembly for sealing the adjustment region between a manhole cover frame and the top opening of a manhole assembly wherein the orientation of one of the telescoping sleeves is reversible to significantly increase the adjustment range.

Still another object of the present invention is to provide a telescoping assembly for sealing the region between a manhole cover frame and the top opening of a manhole assembly against the infiltration of water wherein the top opening is utilized as one of the telescoping sleeves.

Still another object of the present invention is to provide a telescoping assembly for sealing the region between a manhole cover frame and the top opening of a manhole assembly against the infiltration of water wherein the top opening is utilized as one of the telescoping sleeves provided with a flexible sleeve embedded in the manhole assembly to form a telescoping assembly with a cooperating sleeve.

The above, as well as other objects of the present invention will become apparent from consideration of the detailed description and drawings, in which:

BRIEF DESCRIPTION OF THE FIGURES

FIGS. 4*a*–3*d* show sectional views of sealing gaskets which be employed in the telescoping assemblies of FIGS. 1–3;

DETAILED DESCRIPTION OF THE INVENTION AND PREFERRED EMBODIMENTS THEREOF

Figure 1A:
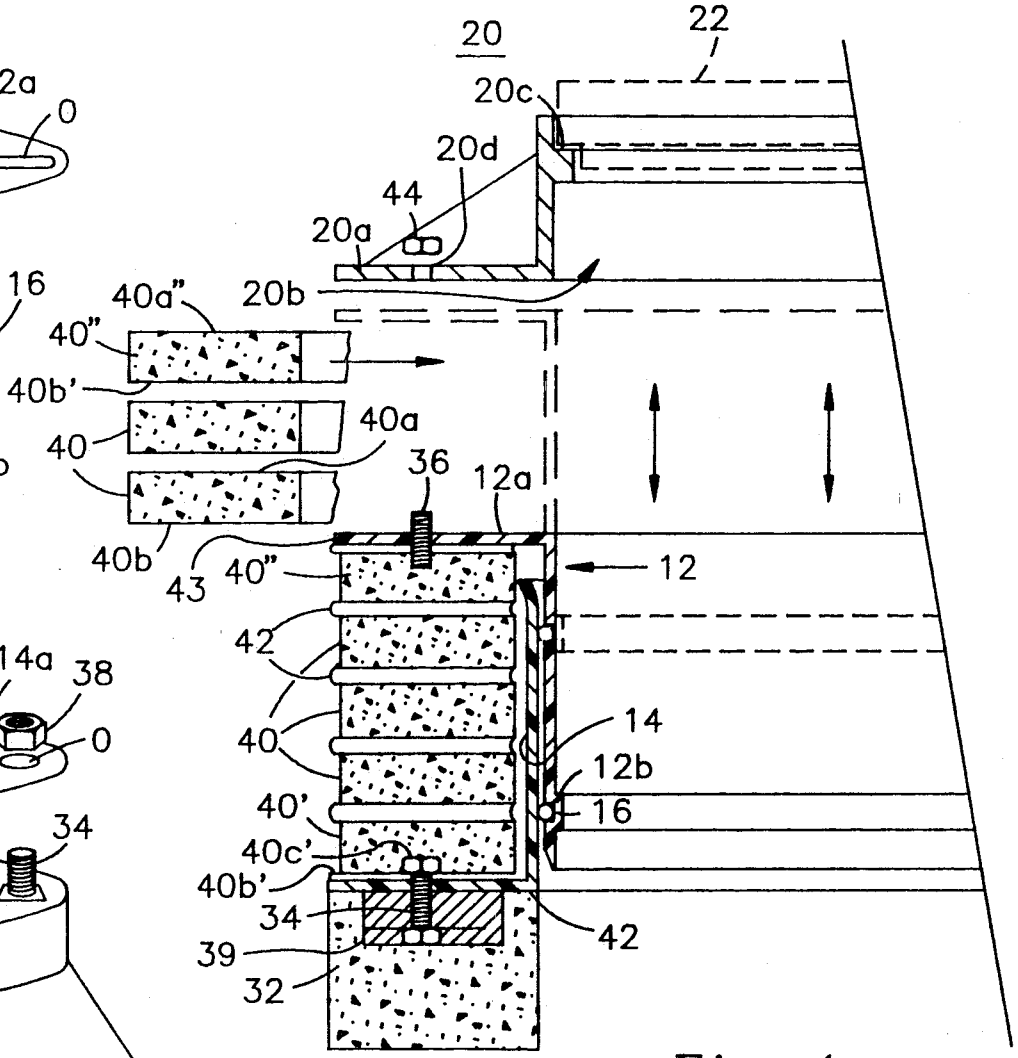
FIG. 1*a* is a sectional view of the embodiment of FIG. 1.
Figure 1:
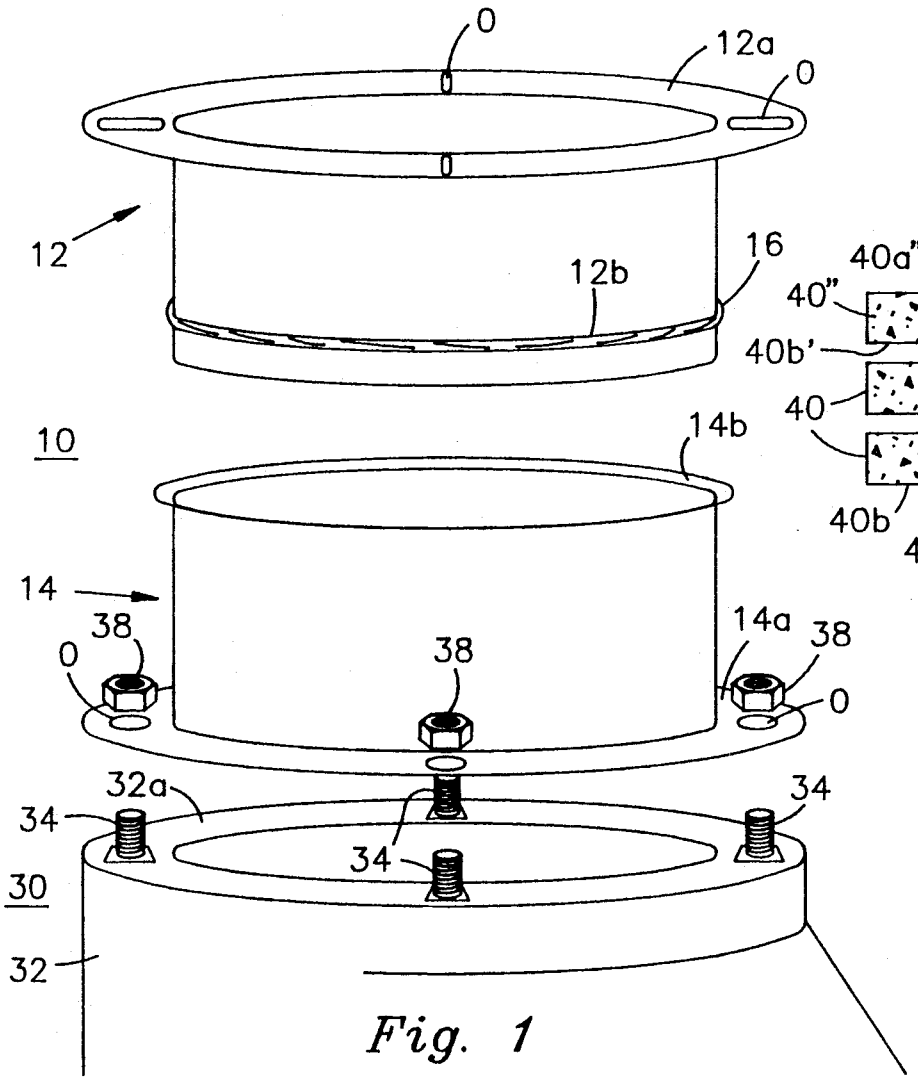
FIG. 1 shows an exploded perspective view of a telescoping seal assembly designed in accordance with the principles of the present invention.

FIGS. 1 and 1*a* show a telescoping assembly 10 embodying the principles of the present invention and being adapted to seal the adjustment region between a manhole cover frame 20 and the upper end of a manhole assembly 30. The manhole assembly 30 is of conventional design and is typically comprised of a manhole base adapted to receive two or more conduits, one or more intermediate sections, the number being dependent upon the distance between the manhole base and grade level, and a tapered, conical top member 32 which serves as the cooperating member for reducing the large diameter of the manhole assembly to the smaller diameter of the manhole cover frame. Note also FIG. 1 of U.S. Pat. No. 4,621,941, showing a typical manhole assembly. The top surface 32*a* of member 32 is provided with a plurality of threaded bolts 34 which are cast into or otherwise secured in member 32 and are utilized to secure the lower telescope sleeve of telescoping assembly 10 thereto as will be described hereinbelow.

The cover frame 20 is comprised of a mounting flange 20*a* for securement of frame 20 either directly to the manhole assembly or to the top grade ring (to be more fully described) and is further provided with a cross-sectional opening 20*b* for receiving a manhole cover 22 which rests upon a shoulder 20*c* when properly seated upon the cover frame to seal the manhole opening.

The cover frame is typically positioned at grade level and one or more positioning rings or grade rings 40 are utilized to provide structural support for cover frame 20 while maintaining the frame at grade level. Each of the grade rings is preferably formed of concrete which is cast into an annular ring having upper and lower planar surfaces 40*a* and 40*b*.

The telescoping assembly 10 is comprised of upper and lower telescoping sleeves 12 and 14 respectively, each being a right cylinder and having an integral mounting flange 12*a*, 14*a*, said flanges being provided with openings 0 for receiving the mounting bolts 34 and 36, as will be more fully described.

Sleeve 12 is provided with an annular groove 12*b* for seating a sealing ring 16 which, in one preferred embodiment, is a resilient O-ring which is preferably a least slightly stretched to facilitate its retention within the seating groove.

Sleeve 14 is provided with a tapered or flared free end 14*b* which acts as guiding taper to facilitate insertion of sleeve 12 into sleeve 14.

The telescoping assembly is mounted in the following manner:

Flange 14*a* is placed upon surface 32*a* of member 32 with each opening in flange 14*a* being aligned to receive one of the upwardly directed threaded mounting bolts 34. A suitable caulking material 42 (note also FIG. 26) is provided to enhance the watertight seal between flange 14*a* and surface 32*a*. The caulking material is preferably a strip comprised of butyl and bentonite. However, any other caulking having similar characteristics may be employed. Bolts 36 are each placed into an associated bolt slot such as the bolt slot assembly 39 embedded into member 32 when it is cast. A preferred bolt slot assembly is described in detail in U.S. Pat. No. 4,719,724, issued Jan. 19, 1988 and assigned to the assignee of the present invention. Nuts 38 are mounted upon bolts 34 and are tightened to secure flange 14*a* to member 32.

One or more grade rings 40 are placed upon flange 14*a*, the total number being dependent upon the spacing required between cover frame 20 and the top surface 32*a* of member 32 to maintain cover frame 20 at grade level.

The bottom grade ring 40' is provided with a plurality of recesses 40*c'*, each being adapted to accommodate one of the nuts 38 each of which threadedly engages one of the threaded bolts 34. Recesses 40*c'* are of a depth sufficient to assure engagement of the bottom surface 40*b'* of grade ring 40' with the top surface of flange 14*a*. A suitable caulking or cementitious material 42 and 43 can be respectively provided between grade rings 40' and flanges 14*a* and 12*a*, if desired.

Additional grade rings 40 are placed upon the bottom grade ring 40' with the number being a function of the required distance between cover frame 20 and the top of manhole member 32 in order to maintain cover frame 20 at grade level. Cementitious caulking material 42 or 43 is provided between adjacent surfaces of the grade rings, as shown.

The top grade ring 40'' is provided with a plurality of openings to accept nut and bolt assembly 36, 44 which secures flange 12*a* to cover frame 20. Telescoping sleeve 12 is oriented in the manner shown in FIG. 1 and is pushed into the top end of sleeve 14, taper 14*b* serving to facilitate guidance and insertion of sleeve 12 into sleeve 14. The openings 0 in flange 12*a* are each aligned to receive one of the threaded bolts 36. Cementitious caulking material 43 can be placed between the engaging surfaces of top grade ring 40'' and flange 12*a*. If desired, the bolt 36 inserted into the bolt slot assembly 39 may be of a length sufficient to extend through openings in flanges 12*a*, 14*a* and the grade rings 40, 40', etc. and be fastened to the upper nut 44 resting on the top surface of the cover flange 20*a*. This alternative arrangement is shown, for example, in FIG. 1 of U.S. Pat. No. 4,719,724. As another alternative, a bolt slot assembly such as the bolt slot assembly 39 of FIG. 1*a* may be provided in the top grade ring 40' shown in FIG. 1*b*.

The cover frame 20 is positioned upon flange 12*a* and aligned so that the openings 20*d* therein each receive one of the threaded bolts 36. A butyl and bentonite caulking strip material (not shown for purposes of simplicity) is provided between flanges 20*a* and 12*a*, to enhance watertightness. Threaded nuts 44 are threaded onto an associated bolt 36 and are tightened to secure the cover frame to the top flange 12*a* of telescoping sleeve 12'.

O-ring 16 cooperates with the interior surface of sleeve 14 to provide an excellent watertight seal, the outer diameter of O-ring 16 being slightly greater than the inner diameter of sleeve 14. The seal is maintained even in the event of expansion or contraction of the concrete supporting structure and specifically grade rings 40–40'' due to ambient heating and/or cooling as well as movement of such components due to surface or subsurface vibrations. Neither of the telescoping sleeves 12 and 14 is relied upon for providing any structural supporting strength for the cover frame thereby enhancing the ability of the telescoping assembly to provide a good watertight seal in spite of variations in the spacing distance between frame 20 and manhole assembly member 32.

Sleeves 12 and 14 are preferably formed of a suitable plastic material such as, for example, polypropylene, polyethylene or PVC which is capable of being molded to provide sleeves of precision size, shape and thickness. However, any other suitable material may be employed which is capable of yielding similar molding and operational characteristics. The sleeves 12 and 14, when assembled, further provide protection of the concrete structures in the adjustment region from corrosion such as may be caused by hydrogen sulfide gas.

Figure 2:
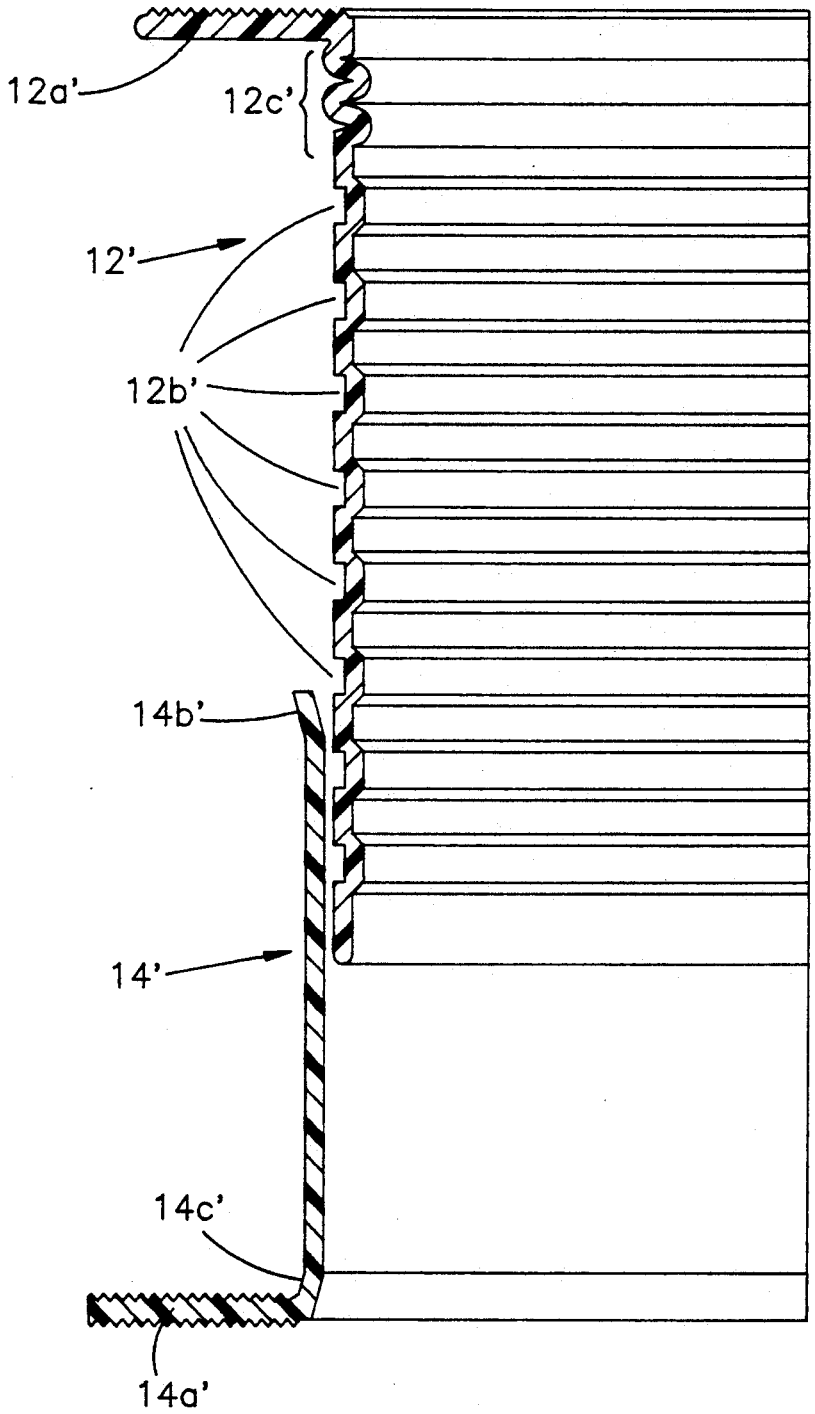
FIG. 2 is a sectional view, partially exploded, showing a telescoping seal of the present invention when fully assembled.
Figure 2A:
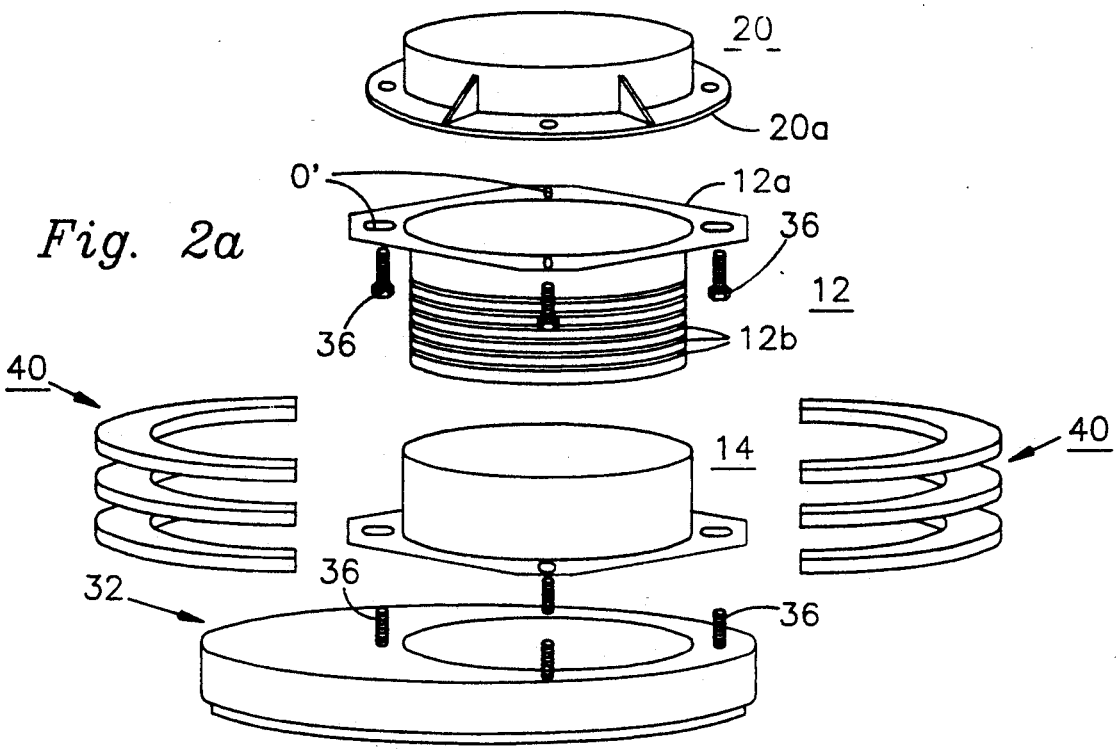
FIG. 2*a* is an exploded perspective view of the embodiment shown in FIG. 2.
Figure 2B:
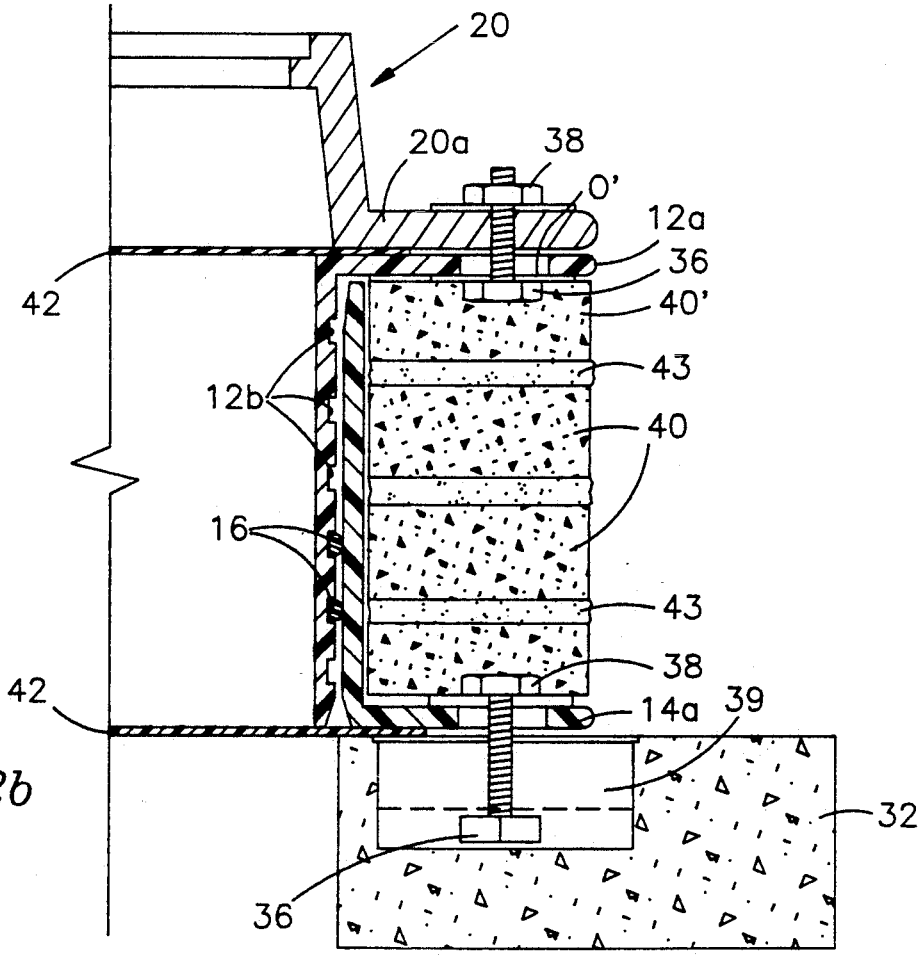
FIG. 2*b* is an elevational sectional view showing the embodiment of FIGS. 2 and 2*a* when assembled.

FIGS. 2, 2*a* and 2*b* show another preferred embodiment of the present invention (like elements in FIGS. 2, 2*a* and 2*b* and in FIG. 1 and FIG. 1*a* being designated by like numerals) wherein sleeve 14' is provided with two guide tapers, namely, tapers 14*b'* and 14*c'* provided in the region where the cylindrical portion of the sleeve merges with flange 14*a'*. Flange 14*a'* is provided with ribbed or saw-toothed-like grooves extending annularly about the flange on both the upper and lower surfaces thereof. This ribbed or saw-toothed pattern enhances the watertight seal between flange 14*a'* and the surfaces in engagement therewith such as, for example, surface 32*a* shown in FIG. 1 and 40*b'* shown in FIG. 1.

The upper surface of sleeve flange 12*a'* is provided with a saw-toothed or ribbed pattern similar to that provided on both the upper and lower surfaces of flange 14*a'* to enhance the watertight seal between flange 12*a'* and the engaging surface of cover frame flange 20*a* (see FIG. 1*a*).

The cylindrical portion of sleeve 12' is provided with a plurality of sealing gasket grooves 12*b'* to permit the selection of that groove which will ultimately receive the sealing gasket or gaskets 16 (see FIG. 1).

The cylindrical portion of sleeve 12' which merges with flange 12*a'* is provided with a corrugated configuration 12*c'* to facilitate axial expansion and contraction thereof. As one example, assuming that the upper surface 40*a''* of top grade ring 40'' is slightly inclined from the horizontal plane, the corrugated section 12*c'* will automatically accommodate such misalignment while maintaining the cylindrical portions of sleeves 12' and 14' and especially O-ring 16', in proper alignment so as not to degrade the watertight seal.

The flanges 14*a'* and 12*a'* have a square-shaped outer periphery as shown best in FIG. 2*a* which serves to reduce the outermost dimensions of the sleeves thereby reducing the total amount of material as well as the space occupied during storage, transportation and handling thereof, while providing a supporting flange of excellent structural strength. The openings O' provided in the flanges are elongated in the radial direction as shown best in FIG. 2*a* to accommodate any misalignment of the mounting bolts 34 or 36.

The manner of assembly of the embodiment shown in FIGS. 2, 2*a* and 2*b* is substantially the same as that shown in FIGS. 1 and 1*a*. In the first assembly example, the sleeves are oriented in the manner shown in FIG. 2 which is substantially identical to the orientation shown in FIGS. 1 and 1*a* and the assembly steps are substantially the same as those described hereinabove in connection with the embodiments of FIGS. 1 and 1*a*.

Figure 2C:
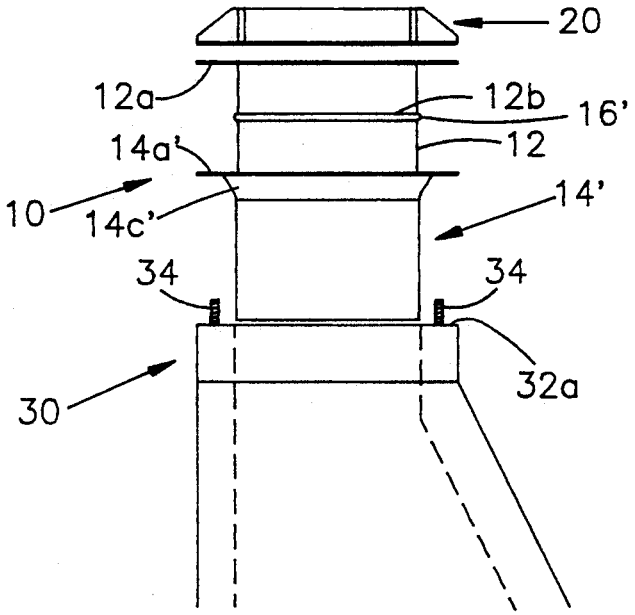
FIG. 2*c* is an elevational view showing another arrangement of the sleeves of FIGS. 2 and 2*a;*

As an additional alternative, the sleeve 14' may be oriented in the manner shown in FIG. 2*c* wherein the cylindrical portion of sleeve 14' is oriented downwardly so as to be telescopingly received within the opening 32b in member 30. Guide taper 14c' is utilized to guide the bottom end of sleeve 12' into sleeve 14'. Sealing gasket 16' provides a watertight seal in a manner similar to that described hereinabove with regard to telescoping assembly 10. The orientation shown in FIG. 2c can accommodate a minimum or "zero" clearance installation requiring either no grade rings at all or a minimum number thereof (such as one or two grade rings) while providing an excellent watertight seal. The grade rings 40 may be split in the manner shown in FIG. 2a, if desired.

Thus, either of the two orientations of sleeve 14' may be chosen depending upon the length of the adjustment area required in order to support cover frame 20 at grade level.

Figure 3A:
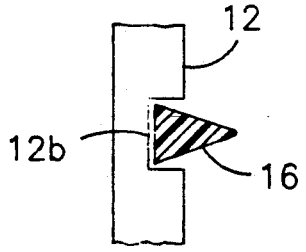
FIGS. 3*a*–3*d* are sectional views of alternative gasket embodiments of the present invention.
Figure 3C:
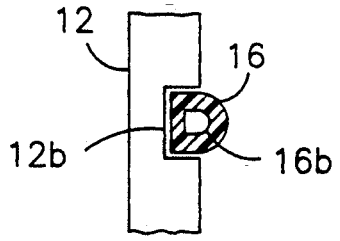
Figure 3B:
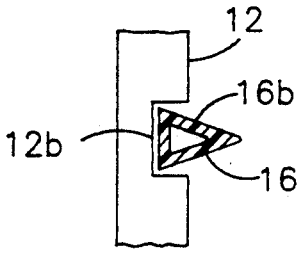

FIGS. 3a–3d show a variety of cross-sectional configurations for the sealing gasket 16 (or 16'). In addition to a circular cross-section, the annular gasket may have a triangular cross-section as shown in FIGS. 3a and 3b. The embodiment of FIG. 3b differs from that shown in FIG. 3a in that the seating groove 12b in FIG. 3b is wider than that shown in FIG. 3a to provide increased resistance to the gasket from turning over. The gasket in the embodiment of FIG. 3c has a semi-circular or "D-shaped" cross-section while the embodiment of FIG. 3d has a substantially rectangular-shaped cross-section provided with a plurality of projections or "fingers" 16a which wipingly engage the interior periphery of the cooperating telescoping sleeve (note, for example, sleeve 14 in FIG. 1), causing the flexible fingers 16a to bend with their free ends moving toward the main body of gasket 16.

As still a further alternative embodiment, the gaskets may be inflatable. Noting, for example, FIG. 3b or FIG. 3c, the gasket may have a hollow interior region 16b which may be inflated through the employment of a thin hypodermic-type needle filling the interior with a suitable liquid which may include water or a suitable plastic or rubber-like material which may "set" when dry. The hollow interior portion is annular in shape and extends around the entire gasket. The flexibility of the gasket is a function of the size of opening 16b and the flexibility of the gasket is further regulated by controlling the amount of air or liquid inserted into the opening.

Figure 4A:
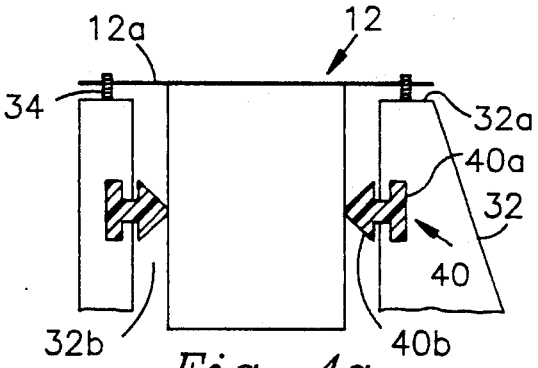

FIGS. 4a–4d show still another embodiment of the present invention in which the opening 32b in manhole assembly member 32 (see FIG. 1a) is utilized as the lower telescoping member. As shown in FIG. 4a, the opening 32b is molded, machined or otherwise formed to have a right cylinder configuration. Gasket 40 is embedded into member 32 when it is cast and is provided, for example, with a substantially T-shaped annular portion 40a embedded within the cast concrete and having joined thereto an integral, triangular-shaped gasket sealing portion 40b. The sleeve 12 is pushed into opening 32b. Sealing portion 40b of gasket 40 embraces the outer periphery of sleeve 12 providing a watertight seal. The flange 12a is adjusted to the proper height by the provision of a suitable number of positioning rings 40 (see FIG. 1a). Assuming that no grade rings are required, flange 12a rests upon surface 32a and flange 12a is fastened to flange 20a of cover frame 20. Alternatively, assuming that one or more grade rings are required to bring cover frame 20 to grade level, the flange 12a is fastened to the bottom surface of flange 20a of cover frame 20 in the manner shown in FIG. 1b. The sleeve 12 in the embodiment of FIG. 4a provides both a watertight seal and protection of the concrete members in the adjustment region against corrosion.

Figure 4C:
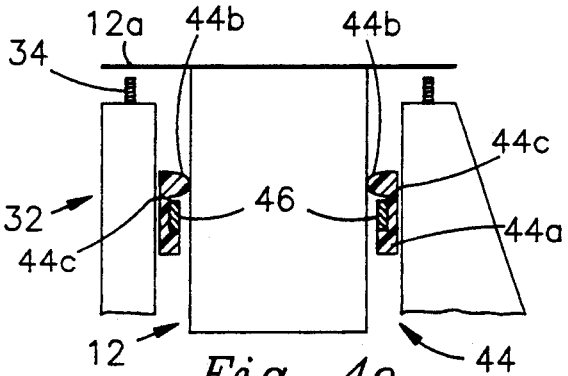
Figure 4B:
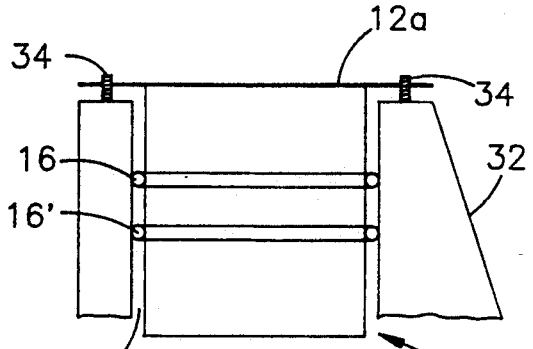

The embodiment of FIG. 4b differs from that of FIG. 4a in that one or more gaskets 16, 16' are mounted within the seating grooves 12b, 12b' provided in sleeve 12, the gaskets forming a watertight seal with surface 32b. Flange 12a will be fastened directly to the bottom surface of flange 20a in all installations, as shown, for example, in FIG. 1b.

Figure 4D:
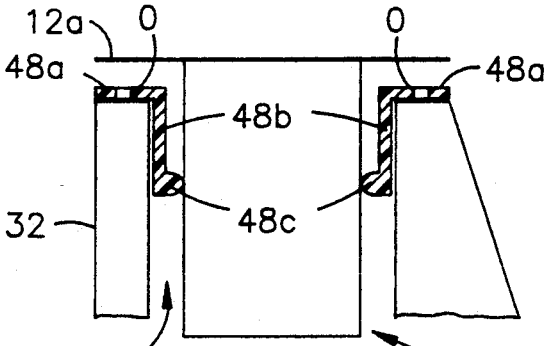

FIGS. 4c and 4d show other alternative embodiments wherein employing the opening 32b as one of the cooperating sleeves and wherein the gasket is mounted to the member 32 in situ. Gasket 44 shown in FIG. 4c is a substantially L-shaped configuration comprised of a clamping portion 44a and a sealing portion 44b. Portion 44a is provided with a recess 44c for receiving a plastic or metal clamping band 46 which is positioned within band receiving recess 44c and is expanded outwardly to clamp the resilient gasket between clamping band 46 and the periphery of opening 32b. Any suitable expandable clamping band may be utilized, for example, the expandable clamping bands shown and described in the U.S. Patents referred to hereinabove disclose suitable clamping bands and the clamping bands described therein are incorporated herein by reference thereto.

Sealing portion 44b embraces the outer periphery of sleeve 12 which is inserted into opening 32b to provide a watertight seal. As was described hereinabove, the sleeve flange 12a is fastened directly to the bottom surface of flange 20a. Sleeve 12 provides the function of a watertight seal as well as protecting the concrete in the region covered by the sleeve from corrosion.

The embodiment of FIG. 4d utilizes a sealing gasket 48 having a substantially L-shaped configuration comprised of a mounting portion 48a and a sealing portion 48b. Portion 48b has a substantially cylindrical-shaped periphery provided with a rounded or semi-circular projection 48c along the inner periphery thereof. The upper end of the gasket extends radially outwardly from the cylindrical portion at substantially right angles thereto forming a mounting flange 48a. The sleeve 12 is pushed into opening 32b. The projecting portion 48c of gasket 48 embraces the outer periphery of sleeve 12 forming a watertight seal. The flange 12a of sleeve 12 is fastened directly to the bottom surface of flange 20a of cover frame 20.

FIGS. 5a–5d show other alternative embodiment of the present invention in which one of the cooperating telescoping sleeves is cast into the manhole member 42. Sleeve 50 is formed of a suitable flexible material such as rubber or a suitable rubber-like material such as EPDM. Sleeve 50 has a cylindrical portion 50a and an integral annular flange 50b of T-shaped cross-section which is embedded in member 32 when it is cast. Sleeve 12 is pushed into the top end of sleeve 50a and an adjustable clamping band 56 such as a conventional adjustable tension band, for example, is tightened about the outer periphery of cylindrical sleeve 50a to create a watertight seal. The watertight seal between sleeve 12 and cylindrical portion 50a may undergo some relative sliding movement due to thermal expansion or contraction of the concrete components in the adjustment region. In addition, the portion of the cylindrical sleeve 12 joined to flange 12a may be corrugated in the manner shown in FIG. 2 to accommodate such expansion and/or contraction. Flange 12a is fastened directly to the bottom surface of flange 20*a* as described above in connection with FIG. 1*b*.

Figure 5A:
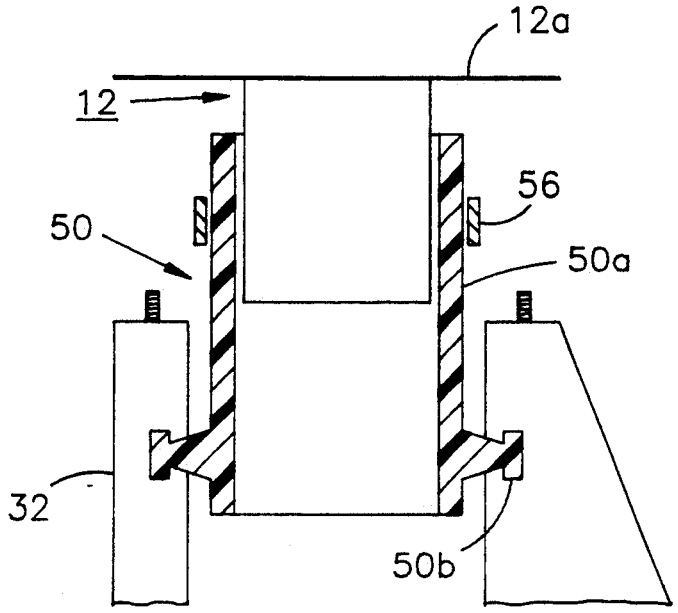
FIGS. 5*a*–5*d* are sectional views showing still another embodiment of the present invention wherein the manhole assembly opening is utilized as one of the telescoping members.
Figure 5B:
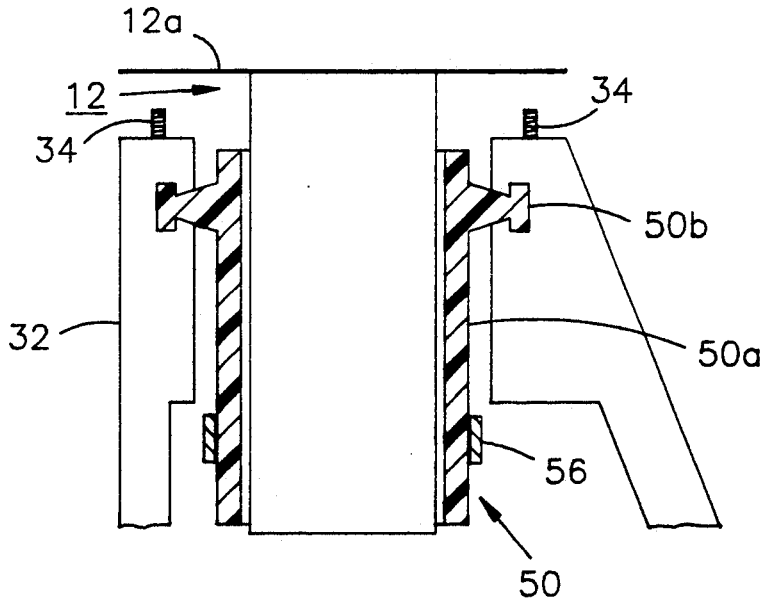

The embodiment of FIG. 5*b* differs from that of FIG. 5*a* in that the cylindrical portion 50*a* is directed downwardly into the member 32. The adjustable tension band 56 is positioned about the outer periphery of sleeve 50*a* and is tightened to provide a watertight seal between sleeve 12 and cylindrical portion 50*a*. Flange 12*a* is fastened directly to the bottom surface of flange 20*a* as was described above in connection with FIG. 1*b*.

Figure 5C:
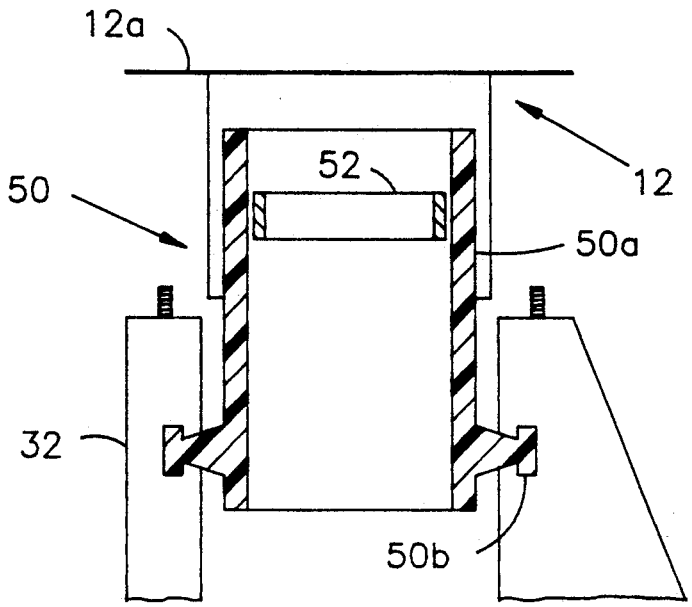

FIG. 5*c* differs from the embodiment of FIG. 5*a* in that the sleeve 12 encircles the cylindrical portion 50*a* of flexible sleeve 50. An expandable clamp 52 of the type described in U.S. Pat. Nos. 4,890,863, issued Jan. 2, 1990 and 4,711,455, issued Dec. 8, 1987, for example, assigned to the assignee of the present invention is expanded radially outwardly to urge the cylindrical portion 50*a* of sleeve 50 into engagement with sleeve 12 to form a watertight seal. The sleeve 12 and cylindrical portion 50*a* cooperate to provide both a watertight seal and to prevent corrosion of the concrete elements in the adjustment region. The flange 12*a* is fastened to the bottom surface of flange 20*a* as shown, for example, in FIG. 1*b*.

Figure 5D:
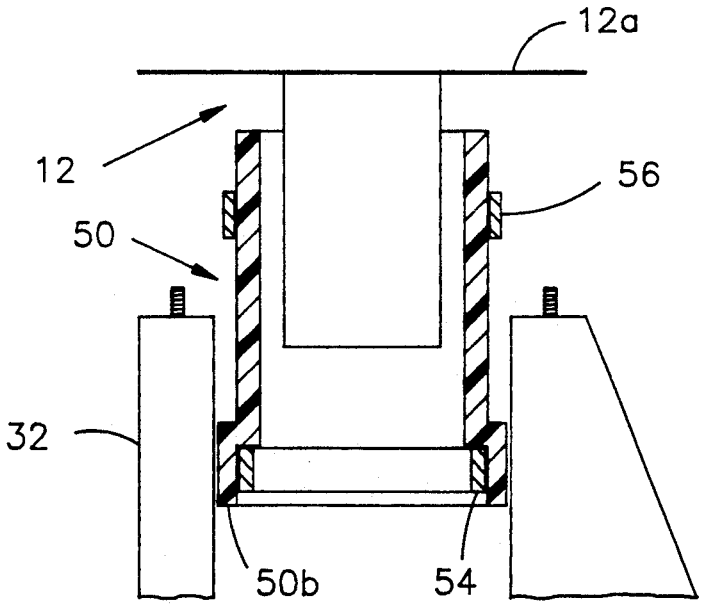

FIG. 5*d* shows an arrangement in which the mounting portion 50*b* of flexible member 50 is clamped to the interior surface of opening 32*a* by clamp 54. The sleeve 12 may be received within cylindrical portion 50*a* which is clamped thereto or may receive cylindrical portion 50*a* in the manner shown in FIG. 5*c*, the cylindrical portion being clamped to sleeve 12 by an expandable clamp 56.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. An assembly for providing a watertight seal between a manhole assembly and a manhole cover support frame, wherein said manhole assembly includes a top member having an access opening for service personnel provided therein and surrounded by a substantially flat top mounting surface, said cover support frame comprising a central opening for receiving and supporting a cover, said cover support frame having an integral flange supportable on said mounting surface, said assembly comprising:

a pair of sleeves each having a hollow cylindrical portion and an integral mounting flange provided at one end of said cylindrical portion;

each of said flanges having openings for receiving mounting bolts;

the diameters of said sleeves being different to enable the sleeve of smaller diameter to be telescopingly received within the sleeve of larger diameter;

the smaller diameter sleeve having an annular seating groove about its outer periphery;

an annular sealing gasket being mounted within said groove and slidingly engaging the interior periphery of the larger diameter sleeve to create a watertight seal therebetween;

the flanges of said first and second sleeves being arranged between said mounting surface and said cover support frame integral flange;

the flange of one of said first and second sleeves engaging the integral flange of said cover support frame; and the openings in said flanges being aligned to receive fastening means for securement to said cover frame and said top member and for compressing both sleeve flanges between said top mounting surface and the integral flange of said cover support frame.

2. The assembly of claim 1 further comprising caulking means being arranged between the engaging surfaces of said sleeve flanges to enhance the watertight seal therebetween.

3. The assembly of claim 1 further comprising caulking means being arranged between the engaging surfaces of a sleeve flange and the cover support frame integral flange to provide a watertight seal therebetween.

4. The assembly of claim 1 further comprising caulking means being arranged between engaging surfaces of a sleeve flange and the manhole assembly top mounting surface to enhance the watertight seal.

5. The assembly of claim 1 wherein said sleeves are formed of a suitable plastic material.

6. The assembly of claim 5 wherein said plastic material is a reinforced plastic.

7. The assembly of claim 5 wherein said plastic material is taken from the group consisting of polypropylene, polyethylene and PVC.

8. The assembly of claim 1 wherein the flanges of said first and second sleeves are provided with a substantially saw-toothed shaped contour along opposite major surfaces of said flange to enhance a watertight seal between each saw-toothed surface and a surface which it engages when assembled and compressed together.

9. The assembly of claim 1 wherein said sealing gasket is a resilient O-ring.

10. The assembly of claim 1 wherein said sealing gasket is an annular-shaped closed-loop resilient member having a substantially D-shaped cross-section defined by a flat surface and a curved surface; and said flat surface being arranged to engage a base of the seating groove.

11. The assembly of claim 1 wherein said sealing gasket is a resilient annular closed-loop member having a substantially triangular-shaped cross-section, one outer surface of said triangular-shaped cross-section engaging a base of the seating groove.

12. The assembly of claim 1 wherein the end of the cylindrical portion remote from said flange of the larger diameter sleeve has an outwardly tapered configuration to provide a guiding taper to facilitate guiding and insertion of the smaller diameter sleeve therein.

13. An assembly for providing a watertight seal between a manhole assembly and a manhole cover support frame, wherein said manhole assembly includes a top member having an access opening for service personnel provided therein and surrounded by a substantially flat top mounting surface, said cover support frame comprising a central opening for receiving and supporting a cover, said cover support frame having an integral flange supportable on said mounting surface, said assembly comprising:

a pair of sleeves each having a hollow cylindrical portion and an integral mounting flange provided at one end of said cylindrical portion;

each of said flanges having openings for receiving mounting bolts;

the diameters of said sleeves being different to enable the sleeve of smaller diameter to be telescopingly received within the sleeve of larger diameter;

the smaller diameter sleeve having an annular seating groove about its outer periphery;

an annular sealing gasket being mounted within said groove and slidingly engaging the interior periphery of the larger diameter sleeve to create a watertight seal therebetween;

the flanges of said first and second sleeves being arranged between said mounting surface and said cover frame integral flange;

the openings in said flanges being aligned to receive fastening means for securement to said cover frame and said top member and for compressing the sleeve flanges therebetween;

the larger diameter sleeve being provided with a tapered cylindrical portion arranged between and integrally joined to an end of said cylindrical portion adjacent said flange and said flange, whereby the tapered cylindrical portion tapers outwardly and merges with said flange to form a guiding taper to facilitate insertion of the smaller diameter sleeve into the end of said larger diameter sleeve adjacent said flange.

14. The assembly of claim 1 wherein at least one of said sleeves has a longitudinal central axis and is provided with an annular corrugated portion located between and respectively integrally joined to said cylindrical portion and said flange to facilitate relative expansion and/or contraction of said cylindrical portion relative to said sleeve flange in a direction of said axis, said corrugated portion having annular corrugations.

15. The assembly of claim 1 wherein the outer periphery of said smaller diameter sleeve is provided with a plurality of seating grooves arranged at spaced intervals therealong for selectively receiving a sealing gasket.

16. The assembly of claim 1 wherein the flanges of said sleeves each have a substantially rectangular-shaped outer perimeter;

the openings in said flange being provided in the region of the corners of said rectangular-shaped flange.

17. The assembly of claim 16 wherein said flange openings are elongated, substantially radially aligned slots to facilitate misalignment of fastening bolts received by said slots.

18. The assembly of claim 1 further comprising a plurality of annular-shaped, load bearing, grade rings arranged between the flanges of said first and second sleeves for supporting said cover support frame, a number of grade rings provided being sufficient to bring the cover support frame to grade level.

19. The assembly of claim 18 wherein said grade rings have substantially flat upper and lower mounting surfaces.

20. The assembly of claim 19 further comprising caulking means provided between facing flat surfaces of adjacent grade rings.

21. The assembly of claim 19 wherein said fastening means further comprises:

first fastening means for securing the flange of the larger diameter sleeve to said manhole assembly mounting surface; and a mounting surface of a grade ring engaging the flange of said larger diameter sleeve being provided with recesses for receiving portions of a fastening means extending upwardly through said flange.

22. The assembly of claim 21 wherein said first fastening means comprises:

a threaded fastening bolt having a head embedded within said manhole assembly top member and having a threaded portion extending upwardly therefrom; and a threaded nut threadedly engaging said threaded bolt, the threaded nut and a portion of the threaded bolt extending above said sleeve flange being received within a recess in said grade ring.

23. The assembly of claim 19 wherein said fastening means comprises second fastening means arranged within a recess in a top grade ring which supports the cover support frame for joining the cover support frame integral flange to the top grade ring and compressing the flange of the smaller diameter sleeve therebetween.

24. The assembly of claim 23 wherein said second fastening means further comprises a threaded member having one end positioned in an recess in said top grade ring and extending upwardly from the upper mounting surface thereof and a cooperating threaded nut threadedly engaging said threaded member for securing said cover frame flange to the flange of said smaller diameter sleeve.

25. The assembly of claim 24 wherein said telescoping sleeves collectively have an axial length sufficient to cover a region between said top mounting surface and said cover support frame integral flange to protect said region from corrosion.

26. An assembly for providing a watertight seal between a manhole cover support frame and a manhole assembly wherein said manhole assembly is comprised of a top member having a central opening and a flat mounting surface surrounding said opening, said cover support frame having a central opening for receiving and supporting a manhole cover and an integral flange for supporting said cover support frame, said assembly comprising:

the central opening in said manhole assembly top member having a cylindrical-shaped interior surface portion;

a sleeve having a cylindrical portion and an integral flange joined at one end thereto and extending radially outwardly therefrom so as to overlie said mounting surface;

said cylindrical portion being telescopingly received and embraced by said cylindrical-shaped interior surface portion;

gasket means secured to said manhole assembly top member embracing and slidably engaging the outer periphery of said sleeve cylindrical portion to provide a watertight seal therebetween; and fastening means for securing said cover frame integral flange to said manhole assembly top member, said sleeve flange having openings for receiving said fastening means and said flange being arranged between said mounting surface and said cover frame integral flange and being compressed therebetween.

27. The assembly of claim 26 wherein said gasket has an integral annular anchoring portion embedded in said manhole assembly top member when it is cast.

28. The assembly of claim 26 wherein said gasket is clamped to the cylindrical-shaped interior surface portion by expandable clamping means to provide a watertight seal therebetween.

29. The assembly of claim 27 wherein said gasket is provided with an integral annular mounting flange extending radially outwardly from a main body portion of said gasket means and overlying said supporting surface, said mounting flange being provided with openings for receiving fastening means employed to secure the cover support frame integral flange to the manhole assembly; said gasket mounting flange being compressed between said cover support frame integral flange and said top mounting surface.

30. The assembly of claim 26 wherein said sleeve has a longitudinal central axis and is provided with an annular corrugated portion located between and respectively integrally joined to said cylindrical portion and said flange to facilitate relative expansion and/or contraction of said cylindrical portion relative to said flange in a direction of said axis, said corrugated portion having annular corrugations.

31. The assembly of claim 26 wherein an outer periphery of said sleeve is provided with a plurality of seating grooves arranged at spaced intervals therealong for selectively receiving a sealing gasket.

32. The assembly of claim 26 wherein said sleeve has a substantially rectangular-shaped outer perimeter;

openings in said sleeve flange each being provided near corners of said rectangular-shaped flange.

33. The assembly of claim 32 wherein said flange openings are elongated, radially aligned slots to facilitate misalignment of fastening bolts received by said elongated slots.

34. The assembly of claim 26 further comprising a plurality of annular-shaped, load-bearing grade rings arranged between the flanges of said sleeve and said top mounting surface to support said cover support frame, the number of grade rings provided being sufficient to bring the cover support frame to grade level.

35. The assembly of claim 34 wherein said grade rings have substantially flat upper and lower mounting surfaces.

36. The assembly of claim 35 further comprising caulking means provided between facing flat surfaces of adjacent grade rings.

37. An assembly for providing a watertight seal between a manhole assembly and a manhole cover support frame, wherein said manhole assembly includes a top member having an opening therein surrounded by a substantially flat mounting surface, said cover support frame comprising a central opening for receiving and supporting a manhole cover and an integral flange supportable on said mounting surface, said assembly comprising:

first and second sleeves each having a hollow cylindrical portion and an integral mounting flange provided at one end of said cylindrical portion;

the flange of said first sleeve having openings for receiving mounting bolts;

the diameters of said first and second sleeves being different to enable a sleeve of smaller diameter to be telescopingly received within a sleeve of larger diameter;

said second sleeve being formed of a resilient flexible material and said flange being an annular anchoring flange integral with said sleeve, said anchoring flange being embedded in said manhole assembly top member when it is cast;

clamping means causing engagement between first and second sleeves to provide a watertight seal therebetween;

the flange of said first sleeve being arranged between said mounting surface and said cover frame flange;

the openings in the flange of said first sleeve being aligned to receive fastening means for securing said cover support frame to said manhole assembly and for compressing the first sleeve flange therebetween.

38. The apparatus of claim 37 wherein said second sleeve surrounds said first sleeve, said fastening means embracing the outer surface of said second sleeve.

39. The apparatus of claim 37 wherein said first sleeve surrounds said second sleeve, said fastening means embracing the inner surface of said second sleeve.

40. The assembly of claim 37 wherein at least one of said sleeves has a longitudinal central axis and is provided with an annular corrugated portion located between and respectively integrally joined to said cylindrical portion and said flange to facilitate relative expansion and/or contraction of said cylindrical portion relative to its associated flange in a direction of said axis, said corrugated portion comprising annular corrugations.

41. The assembly of claim 37 wherein the flange of one of said sleeves has a substantially rectangular-shaped outer perimeter;

openings in said flange each being provided near corners of said rectangular-shaped flange.

42. The assembly of claim 41 wherein said flange openings are elongated, radially aligned slots to facilitate misalignment of fastening bolts received by said slots.

43. The assembly of claim 37 further comprising a plurality of annular-shaped, load-bearing, grade rings arranged between the flange of said sleeve and said top mounting surface for supporting said cover support frame, a number of grade rings provided being sufficient to bring the cover support frame to grade level.

44. The assembly of claim 43 wherein said grade rings have substantially flat upper and lower mounting surfaces.

45. The assembly of claim 44 further comprising caulking means provided between facing flat mounting surfaces of adjacent grade rings.

* * * * *

UNITED STATES PATENT AND TRADEMARK OFFICE

CERTIFICATE OF CORRECTION

PATENT NO. : 5,299,884

DATED : April 5, 1994

INVENTOR(S) : James A. Westhoff and James A. Kelly

It is certified that error appears in the above-indentified patent and that said Letters Patent is hereby corrected as shown below:

Column 1, line 63 change "system sewage," to --sewage system,--

Figure 3D:
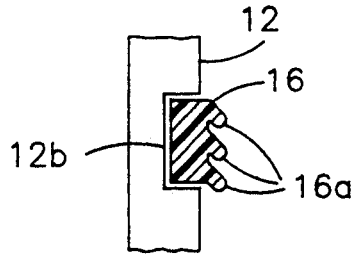

Column 4, line 1 change "Figs. 4a-3d" to --Figs. 4a-4d--.

Column 4, line 54 change "a least" to --at least--.

Column 8, line 49 change "embodiment" to --embodiments--.

Column 12, Claim 24, line 3 of claim, change "an recess" to --the recess--.

Column 12, Claim 24, line 4 of claim, change "the upper" to --an upper--.

Signed and Sealed this

Fifteenth Day of November, 1994

*Attest:*

Bruce Lehman

BRUCE LEHMAN

*Attesting Officer*

*Commissioner of Patents and Trademarks*